United States Patent [19]

Wittern et al.

[11] Patent Number: 4,779,760

[45] Date of Patent: Oct. 25, 1988

[54] ARTICLE RELEASE MECHANISM

[75] Inventors: Francis A. Wittern, Des Moines; Arthur N. Wirstlin, Altoona, both of Iowa

[73] Assignee: Fawn Engineering Co., Des Moines, Iowa

[21] Appl. No.: 152,462

[22] Filed: Jan. 19, 1988

Related U.S. Application Data

[60] Division of Ser. No. 3,062, Jan. 14, 1987, abandoned, which is a continuation of Ser. No. 747,280, Jun. 21, 1985, abandoned.

[51] Int. Cl.[4] ..... G07F 11/00

[52] U.S. Cl. ..... 221/283; 221/289; 221/299; 211/59.2

[58] Field of Search ..... 221/197, 283, 282, 285, 221/289–301, 241; 211/59.2; 312/45

[56] References Cited

U.S. PATENT DOCUMENTS

| | | | |
|---|---|---|---|
| 3,322,303 | 5/1967 | Grindinger et al. | 221/298 |
| 3,348,733 | 10/1967 | Johnson | 221/298 |
| 4,217,991 | 8/1980 | Neuhaeusser et al. | 221/295 X |
| 4,479,583 | 10/1984 | Franklin et al. | 211/59.2 |

*Primary Examiner*—Charles A. Marmor
*Attorney, Agent, or Firm*—Henderson & Sturm

[57] ABSTRACT

Articles such as cans vertically stacked on a serpentine shelf (30) and on a longitudinally inclined shelf (33) at the lower end thereof are dispensed one at a time by a motor driven article release mechanism (24). A single can is dispensed for each user actuation of the release mechanism (24). A pair of longitudinally and arcuately spaced fingers (72), (73) are mounted for rotation as a unit as a part of the mechanism (24), and extend at right angles to the longitudinal axis of the cans in the section. The lowermost finger (72) is normally in can-blocking position and the upper finger (73) is normally in a non-can-blocking position. Upon actuation of the mechanism, the fingers are rotated sequentially from their normal positions to a second position, where a lowermost can (C′) is released and the next adjacent can (C″) held in place, to their normal positions where the next adjacent can (C″) moves by gravity down against the lowermost finger (72). The motor driven article release mechanism (24) removably mounted on transverse rods (32) extended across the inclined shelf (33) by longitudinal movement relative to the rods (32).

1 Claim, 3 Drawing Sheets

ARTICLE RELEASE MECHANISM

This application is a division of U.S. applcation Ser. No. 07/003,062 filed Jan. 14, 1987, now abandoned, which is a continuation of U.S. application Ser. No. 06/747,280 filed June 21, 1985, now abandoned.

TECHNICAL FIELD

The present inventon relates generally to article vending machines, and more particularly to a mechanism located at the bottom of a stack of articles for sequentially releasing the articles.

BACKGROUND ART

The present invention relates to vending machines wherein an article dispensing mechanism is provided at the lower end of a column of stacked articles, such as cans, for releasing in response normally to the deposit of one or more coins, a single can. More specifically, the invention relates to the article dispensing mechanism itself wherein one or more fingers are movably arranged for actuation by a solenoid or the like to provide for successive and sequential blocking and releasing of a lowermost can while holding or otherwise retaining the next adjacent can until the lowermost can is released, whereupon the next adjacent can is released to move to the blocked lowermost position.

The prior art to which the invention pertains is developed and typified by U.S. Pat. Nos. 3,348,733, issued Oct. 24, 1967 to E. C. Johnson; 3,507,419, issued Apr. 21, 1970 to J. C. Lindsay, et al.; 3,627,172, issued Dec. 14, 1971 to L. D. Gore, et al.; 3,627,174, issued Dec. 14, 1971 to J. W. Baxendale; 3,737,070, issued June 5, 1973 to W. O. O'Neal; and 3,831,806, issued Aug. 27, 1974 to J. C. Lindsay.

While the prior art shows paddle wheels, rotatable fingers, pivoted can retaining plates, can tilting structures, or detents all activated in one manner or another by motors or solenoids to release one article by gravity from a column or stack of articles while retaining the remaining articles therein, these devices are complicated, have too many parts, and are expensive to manufacture and maintain; being subject also to malfunction due to their complexity. Nor does the prior art show a quick and simple removal of the entire article dispensing mechanism for ease of service and maintenance.

DISCLOSURE OF INVENTION

In the present invention, the mechanism for releasing articles, such as cans as shown herein, is located near the bottom of a generally vertical serpentine stack of cans with a lower straight run shelf, and with the lowermost can in a position to be released and dispensed as in the case of a coin actuated dispenser. The cans move down the stack by gravity rolling at right angles to their longitudinal axes. A pair of spaced fingers rotate on and with a shaft as a unit directly above the straight run shelf, the shaft rotating about an axis at right angles to the longitudinal axes of the cans. The fingers are adjustably mounted on the shaft for movement longitudinally and arcuately thereof.

The lead finger closest to the front release end of the shelf is normally in a "down" position blocking the lowermost can from rolling forward to a dispensed position, and the rear finger is normally in an "up" position, extended above and out of the way of the cans. The release mechanism comprises further a motor energized as by a coin insertion in the coin mechanism, and is rotatably connected to the shaft. Rotation of the shaft occurs through a 360° arc, moving the lead finger through an up position to release the lowermost can while moving the rear finger through a down position, blocking the next to the lowermost can, then moving both fingers back to their initial normal positions.

The release mechanism comprises further a bracket which utilizes the conventional serpentine support rods for mounting the mechanism in a suspended manner such that by a single longitudinal movement the mechanism can be lowered for removal out the front of the shelf and the vending machine.

An object of this invention is to provide a novel article release mechanism which has but only a single unitary pair of fingers movable between article blocking and article release positions for engaging the articles to be manipulated.

Another object of this invention is to provide in such an article release mechanism for the fingers to be adjustably movable on the shaft for adaptation to articles of various sizes.

Still another object of this invention is to provide such an article release mechanism which is simple and rugged, easy to manufacture, effective in operation, and easily removable for servicing.

BRIEF DESCRIPTION OF THE DRAWINGS

These and other objectives of the invention will become more clear upon a thorough study and review of the following detailed description of the preferred embodiment for carrying out the invention particularly when reviewed in conjunction with the accompanying drawings, wherein.

BEST MODE FOR CARRYING OUT THE INVENTION

Figure 1:
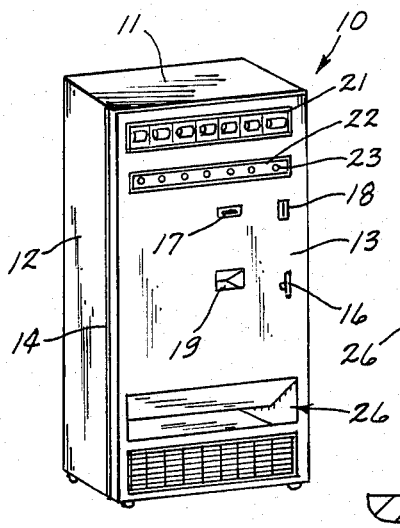
FIG. 1 is a perspective view of a typical vending machine for using the article release mechanism hereof.

Referring now to the drawings wherein like reference numerals designate identical or corresponding parts throughout the several views, FIG. 1 shows a vending machine (10) constructeo to utilize the present invention The vending machine (10) has an outer housing with a top (11) and sides (12). A front opening door (13) is pivotally attached thereto by means of a hinge (14). The front door (13) includes a latch (16) for selectively opening or closing the door (13). A coin slot (17), a coin return lever (18), and a coin return depression

(19) are provided in the door (13) for receiving and returning coins in the normal, well-known manner of using the machine (10).

An upper row (21) of display windows corresponds to a row (22) of button-type switches below such that when a selection is made in the upper row (21), a corresponding button (23) in row (22), which is directly below such selection, is pushed. The button (23) will actuate an article release mechanism (24) (FIG. 3), and an article will drop into a discharge opening (26). The row (21) is shown as soda pop cans, for example. It is to be understood that this top row (21) of windows as illustrated does not show the inside of the machine, but instead merely has a sample of the proper selection therein as compared to the corre sponding button below, although it would be possible to use a window that would merely show through to the top row of what is inside the machine if desired.

Figure 2:
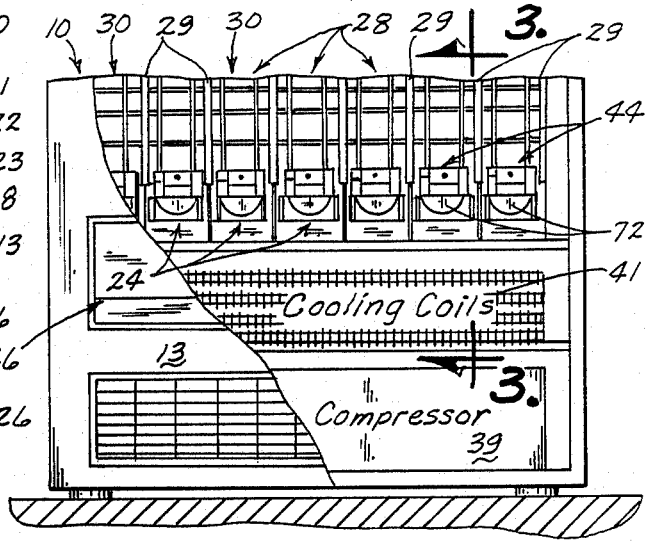
FIG. 2 is an enlarged front elevational view of the lower part of the machine, part of the front door broken away.
Figure 3:
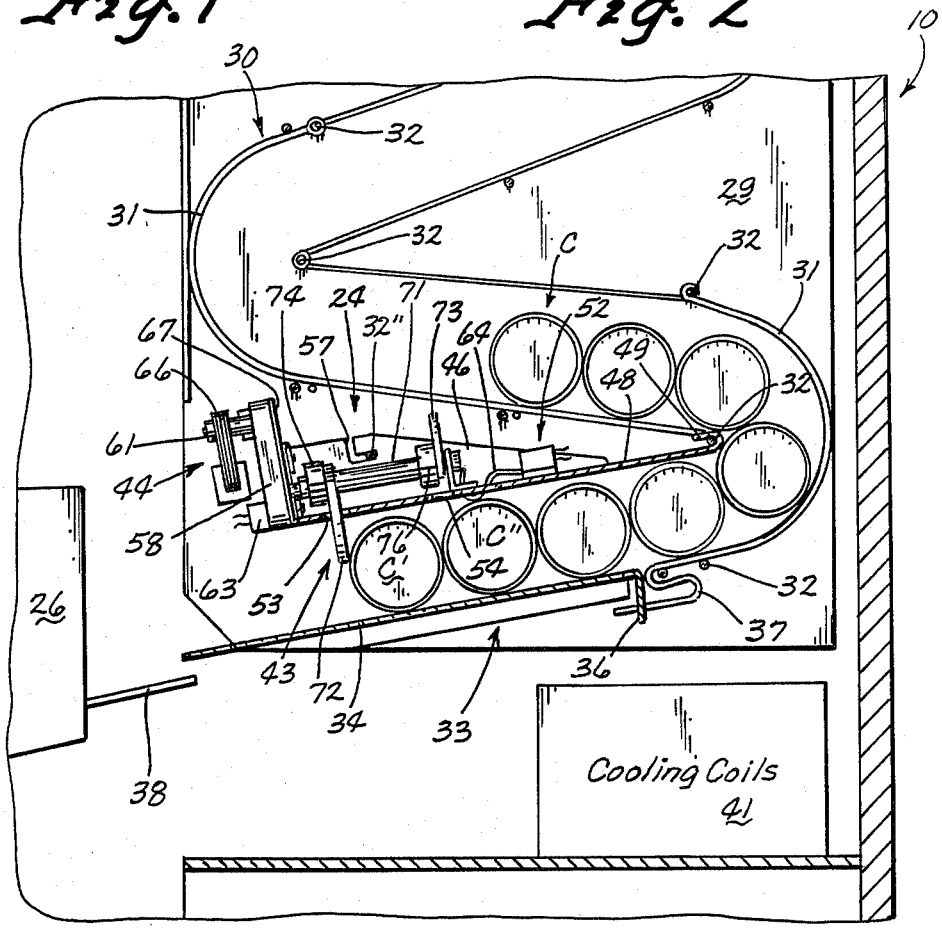
FIG. 3 is a further enlarged cross-sectional view taken along the line 3—3 in FIG. 2.

Referring particularly to FIGS. 2 and 3, the machine (10) includes a plurality of vertically disposed columns (28) arranged side-by-side within the machine (10). Each column comprises a plurality of pairs of vertical, horizontally spaced walls (29), (31), and J-shaped wire sections (29) fastened to the walls (29), (31) by transverse rods (32) arranged in an alternating, spaced relation as shown in FIG. 3. The sections (29) form a well-known serpentine stack (30) in which articles such as cans are contained for vending as by rolling movement downwardly to a dispensing position.

A longitudinally inclined, lower straight run shelf (33) (FIG. 3) is provided at the base of each column (38) and comprises a flat floor plate (34) connected at one end (36) to a reversibly curved end (37) of a section (29) and the front of which is disposed slightly above and over an outer, rear end (38) of a shelf part of the delivery unit (26). The straight run shelf (33) is completed by the article release mechanism (24) of this invention which is suspended on a pair of rods (32') and (32") (FIG. 3) in a manner detailed hereinafter. Below the lower straight run shelf (33), a compressor (39) with appropriate cooling coils (41) is mounted within the cabinet interior at the bottom thereof.

The article or can release mechanism (24) comprises a mounting bracket (42), a finger unit (43), and an electric actuating unit (44) connected in any conventional manner and circuitry to the respective button switch (23) of the row (22) for vending the cans C held in that particular stack (30). The bracket (42) includes an U-shaped element having upturned sidewalls (46), (47) (FIG. 5) and a relatively flat member (48) which forms the upper wall or ceiling of the lower straight run shelf (33) (see FIG. 3). The inner end of the member (48) has a loop (49) shape such that it can be looped about the rod 32', and the outer end (51) is bent upwardly to provide a support wall.

To accommodate the finger unit (43) and a sold-out switch unit (52), the latter not being a part of this invention, the mounting bracket flat member (48) has a plurality of openings (53), (54) and (56) (FIG. 5) formed therein whereby fingers and switches detailed hereinafter can move from positions above the cans C in the shelf (33) to positions engaging the said cans C. Additionally, a pair of transversely opposed L-shaped slots (57) (FIGS. 3 and 8) are formed in the sidewalls (46) (47) such that by proper positioning of the bracket (42) between the column walls (29), (31), the rod (32")(FIG. 3) will be received within the slots (57) and located rearwardly therein such that, with the loop (49) engaging rod (32'), the bracket (42) is securely suspended in place.

The actuating unit (44) comprises a conventional fractional horsepower motor (58) having a drive shaft (59), a spring biased armature (61), a main power switch (62), a timer microswitch (63), and the sold out switch (52) with leaf springs (64). Upon deposit of a coin in slot (17), the field (66) is energized drawing the armature (61) therein and effecting driving rotation in a clockwise rotation of the drive shaft (59). After a 360° rotation of the shaft (59), the switch (63) effectively de-energizes the armature (61) which returns by spring action to its non-motor energizing position. The unit (44) is mounted on a plate (67) fastened in turn to the upturned end (51) of the mounting bracket (42).

Figure 5:
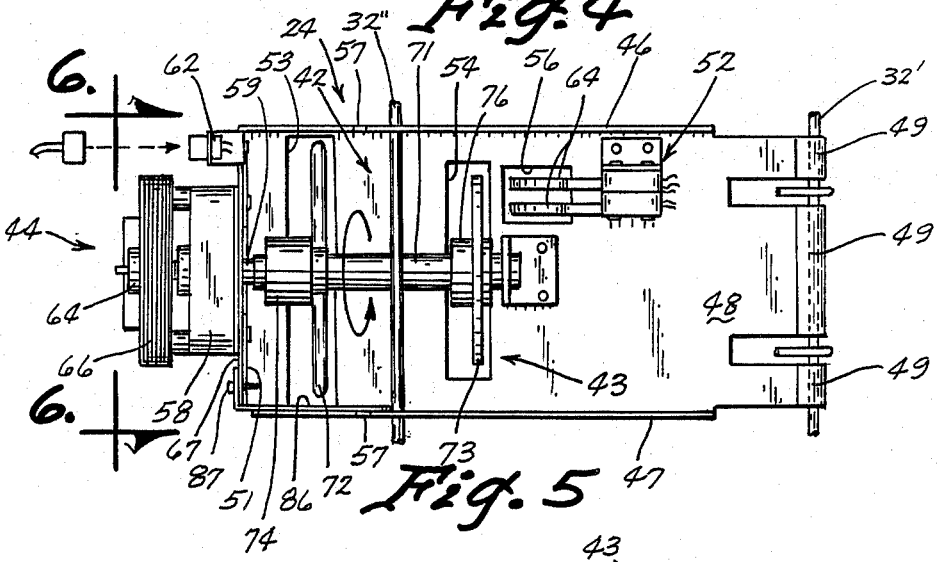
FIG. 5 is a plan view taken along the line 5—5 in FIG. 4.
Figure 6:
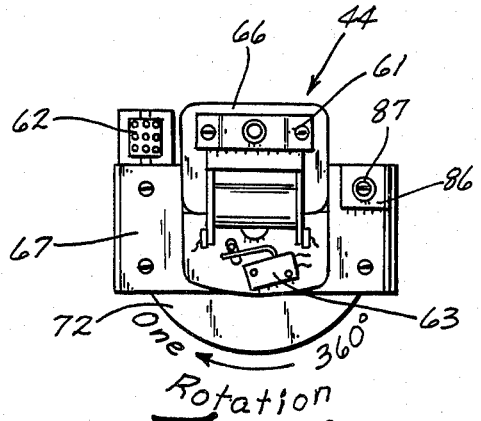
FIG. 6 is a front elevational view taken along the line 6—6 in FIG. 5.
Figure 7:
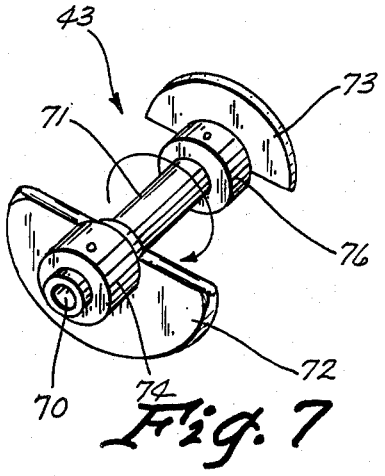
FIG. 7 is a perspective view of the fingers and shaft unit of the release mechanism.

Referring to FIGS. 3, 5 and 7, the finger unit (43) is clearly illustrated. It comprises a shaft (71) extended parallel to the flat member (48) and the direction of movement of the cans C down the straight run shelf (33), a pair of spaced fingers (72), (73) mounted on the shaft (71) for rotation as a unit, the lowermost lead finger (72) (FIG. 3) normally extended through its slot (53) in a position blocking downward movement of the lowermost can C' and the rear finger (73) normally extended above its slot (54) and the mounting bracket member (48) out of the way of the can C" next adjacent the lowermost can C'.

More particularly, although the finger unit (43) could be molded as one piece, the preferred form is in three separate pieces for the advantage of adjustability. The shaft (71) is recessed at its front end (70) to receive the motor drive shaft (59). The lead finger (72) has a relatively flat, semi-circular arcuate shape with a bearing portion (74) providing for fastening to the shaft (71), and the rear finger (73) likewise has a substantially identical shape as the lead finger (72), also with a bearing portion (76) for adjustable fastening to the rear end of the shaft (71). In this manner, the fingers are movably adjustable both longitudinally and arcuately on the shaft (71).

The fingers (72), (73) are spaced apart on the shaft (71) at least the full diameter of a can C, or the full length of an article longitudinally of the shelf (33). It will further be noted that the lead finger (72) when in its normal position with its radial midpoint extended straight downwardly from the shaft (71) extends approximately 180° radially from the rear finger (73) when the latter is in its normal position with its radial midpoint extended straight upwardly. Also, in those relative arcuate positions, the full arcuate extent of the fingers (72), (73) is at least a full circle.

Figure 4:
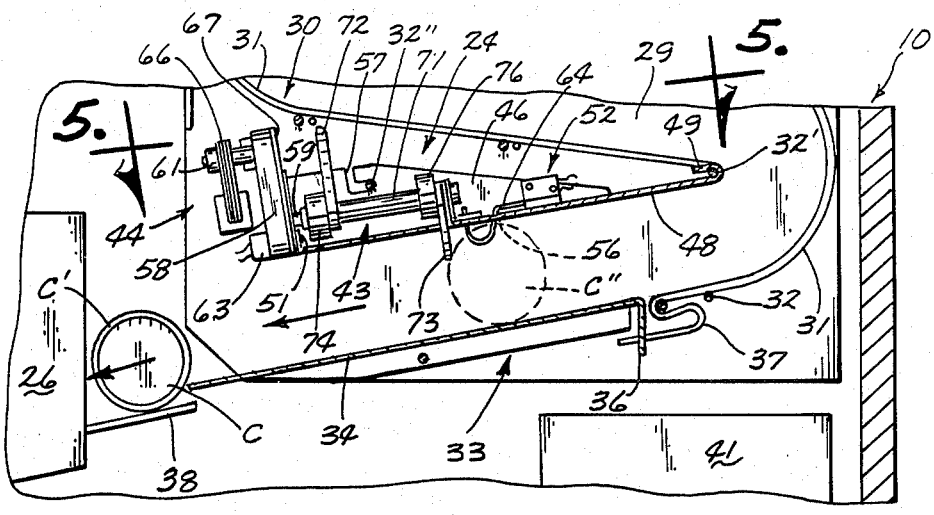
FIG. 4 is a view similar to FIG. 3 showing the release mechanism fingers in an alternate position.

In operation, when the vending machine user has made his/her selection and deposited the coin, energization of the motor (58) results in the drive shaft (59) rotating the finger unit shaft (71) a full 360° rotation, after which continued coin deposits will effect a succession of 360° arcuate movements of the finger unit (43). Thus, as the shaft (71) and fingers (72), (73) rotate from their normal positions of FIG. 3 to a 180° arcuately moved position of FIG. 4 wherein the lead finger (72) is above the path of the cans C and the rear finger (73) is in their path, the lead can C' is released to continue its downward rolling movement to the discharge area (26) while the next can C" is held in place. Continued rotation of the finger unit (43) to complete the 360° arcuate movement then results in the rear finger (73) (FIG. 4) releasing the can C", permitting it to roll forwardly to the next station where it is blocked by the lead finger (72), the fingers (72), (73) having rotated to their original "normal" position (FIG. 3). The sold-out switch leaf springs (64) remain depressed so long as a can C engages them, thus indicating a supply of cans C. When not engaged, the usual sold-out indication is made on the door (13) for the customer as to that particular column (28), but the circuitry is arranged to not affect the vending capabilities of the other columns. The switch unit (52) is not a part of this invention and conventional equipment is utilized for indicating and managing sold-out situations.

Figure 9:
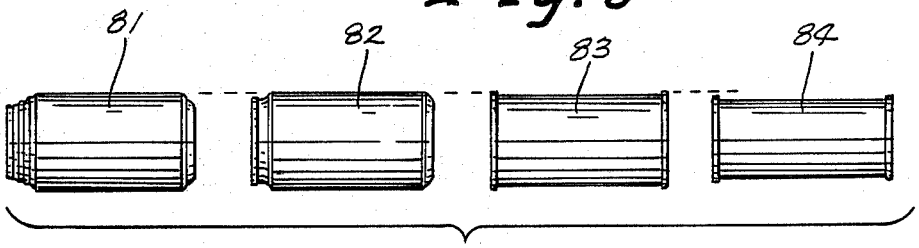
FIG. 9 is a view of four cans of different sizes and shapes which can be handled by the release mechanism of this invention.

Should articles to be vended other than cans C be inserted into one of the serpentine columns (28) (FIG. 2), by removing an Allen-type screw from a finger bearing block (74) or (76), either finger (73), (73) can be adjusted lengthwise of the shaft (71); and of course if the slot openings (53), (54) need be enlarged to accommodate any such shifting, such can readily be accomplished. Four cans (81), (82), (83) and (84) are illustrated in FIG. 9 to show different shapes and diameters of cans which can be vended using the mechanism (24) described herein.

Figure 8:
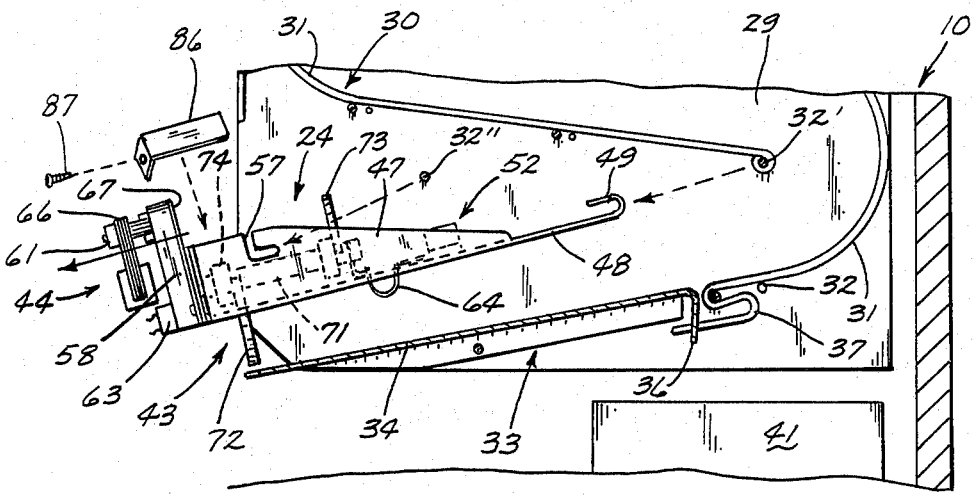
FIG. 8 is a view similar to FIG. 3 and showing the release mechanism in a position removed from its normal suspended position.

Quick removal of the article release mechanism (24) from the bottom of a column (28) has been described hereinbefore; further, FIG. 8 shows a locking plate (86) movably and removably attached by a fastener (87) to the motor mounting plate (67) for preventing the mechanism (24) from being moved from its use position. In this regard, the plate (86) can be moved from a position away from the slot (57), such that the mounting bracket (42) can be shifted rearwardly of the rod (32″) and then removed therefrom, to a position adjacent the rod (52″) to prevent shifting of the bracket (42).

While the invention has been described with reference to a particular embodiment, changes or modifications may now be suggested to those skilled in the art without departing from the inventive concept or scope of the appended claims.

I claim:

1. In an article dispensing machine:

article support means having an elongated longitudinally inclined section adapted to receive a plurality of articles arranged in a line extending longitudinally of said section and to shiftably support the articles for movement toward and successive dispensing from the lower end of said section, said section comprising a floor for the articles, means on each side of said floor to guide the articles downwardly on said floor, and a pair of rods connected to and extended between said side means above said floor, one rod adjacent the rear of the section and the other rod adjacent the front of the section at the lower end of the shelf; and article release support means comprising a bracket having sidewalls and a rearwardly extended finger connected thereto, said sidewalls having a pair of laterally spaced L-shaped grooves formed therein for receiving said other rod, and said finger having a reverse loop at its outer end for receiving said one rod, said bracket movable longitudinally of said shelf from a position wherein said rods support said bracket to a second position wherein said bracket is detachable from said rods.

* * * * *